US010065304B2

(12) United States Patent
Bensman et al.

(10) Patent No.: US 10,065,304 B2
(45) Date of Patent: Sep. 4, 2018

(54) CASE

(71) Applicant: The Stanley Works Israel Ltd., Rosh Ha'Ayin (IL)

(72) Inventors: Mark Bensman, Rosh Ha'Ayin (IL); Miki Birnbaum, Rehovot (IL); Nadine Daniel Horovitz, Rehovot (IL); Yosi Sabbag, Holon (IL); Gaddi Lewinski, Haifa (IL)

(73) Assignee: The Stanley Works Israel Ltd., Rosh Ha'Ayin (IL)

( * ) Notice: Subject to any disclaimer, the term of this patent is extended or adjusted under 35 U.S.C. 154(b) by 268 days.

(21) Appl. No.: 14/794,470

(22) Filed: Jul. 8, 2015

(65) Prior Publication Data

US 2016/0008973 A1 Jan. 14, 2016

(30) Foreign Application Priority Data

Jul. 9, 2014 (EP) ..... 14176401

(51) Int. Cl.
*B65D 85/28* (2006.01)
*B25H 3/02* (2006.01)
*B65D 43/16* (2006.01)

(52) U.S. Cl.
CPC ..... *B25H 3/023* (2013.01); *B65D 43/16* (2013.01)

(58) Field of Classification Search
CPC . B25H 3/00; B25H 3/003; B25H 3/02; B25H 3/021; B25H 3/022; B25H 3/023; B25H 3/025; B25H 3/04; B65D 43/00; B65D 43/14; B65D 43/16
See application file for complete search history.

(56) References Cited

U.S. PATENT DOCUMENTS

| | | | | |
|---|---|---|---|---|
| 818,712 | A | 4/1906 | Shaw | |
| 5,947,286 | A * | 9/1999 | Chau | A45C 13/02 190/40 |
| 7,255,229 | B2 * | 8/2007 | Roesler | B25H 3/003 206/379 |
| 8,210,387 | B2 * | 7/2012 | Twig | B25H 3/022 220/521 |
| 2006/0037964 | A1 * | 2/2006 | Su | B65D 21/0212 220/826 |

OTHER PUBLICATIONS

Chinese Office Action dated Nov. 6, 2017.

* cited by examiner

*Primary Examiner* — Steven A. Reynolds
*Assistant Examiner* — Javier A Pagan
(74) *Attorney, Agent, or Firm* — Bruce S. Shapiro; Carl E. Myers

(57) ABSTRACT

A tool case includes a body having a base and a pivotal lid, forming a storage space therein. A pair of panels is located in the storage space when the lid is closed. The first panel and the second panel are pivotally connected to each other at a common hinged edge, the pair of panels being movable between a stowed position in relation to the body, and an expanded position in relation to the body, such that in the expanded position at least one surface of each of the first and second panel are accessible. The first panel further comprises at least one unfixed edge and the second panel further comprises at least one fixed edge pivotally connected to the body. In the stowed position, the unfixed edge is substantially proximate to the fixed edge. In the expanded position, the unfixed edge is substantially distant from the fixed edge.

10 Claims, 12 Drawing Sheets

CASE

CROSS-REFERENCE TO RELATED APPLICATIONS

This application claims priority to EP Application No. 14176401.9, filed on Jul. 9, 2014, entitled "Case." The content of this application is incorporated herein by reference in its entirety.

FIELD OF THE INVENTION

The present invention relates to cases for carrying items, for example tools. It is often advantageous to have a plurality of tools, which are needed for accomplishing a task, readily and easily available within convenient reach in one container. It is also desirable for such tools to be easily transported from one place to another and retrieved easily when needed. Some professions require sets of tools of differing sizes, for example a set of spanners, and sub-division of the storage space within a case can assist in keeping sets of similar tools in order, particularly if some of the tools are relatively small. For example, containers may be provided with internal storage panels to sub-divide a storage space, and such panels may be provided with racks to hold tools on the panel surface, or other sub-compartments to provide a convenient way to keep each set together and in order, so that the correct tool can easily be selected from the set.

BACKGROUND OF THE INVENTION

Cases having a base and a lid, which comprise one or more internal panels for storing tools are known. The user must open the case and obtain access to the correct panel before selecting the required tool from the panel.

The aim of the present invention is to increase the amount of storage space which is accessible simultaneously when a compartmentalised or subdivided case is open.

BRIEF SUMMARY OF THE INVENTION

The present invention provides a case for organizing and transporting a plurality of tools, the case having at least one pair of hinged storage panels arranged within the case to compartmentalise the storage space, the panels being movable between a stowed position and an expanded position which allows access to tools stored on surfaces of the panels. When the body of the case is in a closed position, the lid is closed and latched to the base, and the hinged panels are stowed in the storage space of the case. When the lid of the case is open, the storage face of the at least one of the hinged panels may be accessed. Furthermore, when the lid of the case is open, the hinged panels may optionally be moved into an expanded position, such that storage faces of both of the hinged panels may be accessed. Tools which are required frequently may be stored on the first or front panel, such that they are quickly accessible as soon as the case is open. However, a larger range of additional tools can be stored on the second or back panel, such that the hinged panels can be set in the expanded position within reach of a user, so that all of the tools required for a particular job are within easy reach at once, without having to flip between panels.

In an embodiment of the invention, there is provided a case having a body, the body comprising a base and a lid, wherein the lid is pivotally connected to the base, and a storage space is substantially defined by the base and lid, such that the storage space is accessible when the lid is in an open position but is not accessible when the lid is in a closed position. The case further comprises a pair of panels located in the storage space when the lid is in a closed position, wherein the pair of panels comprises a first panel and a second panel, the first panel and second panel being pivotally connected to each other at a common hinged edge, the pair of panels being movable between a stowed position in relation to the body, and an expanded position in relation to the body, such that in the expanded position at least one surface of the first panel and at least one surface of the second panel are accessible. The first panel further comprises at least one unfixed edge, and the second panel further comprises at least one fixed edge pivotally connected to the body of the case, wherein in the stowed position, the unfixed edge of the first panel is substantially proximate to the fixed edge of the second panel, and in the expanded position, the unfixed edge of the first panel is substantially distant from the fixed edge of the second panel.

Optionally, the unfixed edge of the first panel may be opposite to the common hinged edge of the first panel, and the fixed edge of the second panel may be opposite to the common hinged edge of the second panel. The pair of panels may comprise one or more storage racks, and optionally, each of the first panel and the second panel may comprise one or more storage racks.

Optionally, when the pair of panels is in the stowed position, the storage racks of the second panel are cradled within the lid of the case, and additionally the storage racks of the first panel may also be cradled within the lid of the case.

The body of the case may comprise a stop, such that when the pair of panels is in the expanded position, the unfixed edge of the first panel abuts the stop and the first panel is held at a stable position in relation to the body of the case. One or more latches may be arranged to latch the pair of panels in the stowed position in relation to the body of the case, wherein release of the latches allows the pair of panels to move into the expanded position in relation to the body of the case. A spring, for example a flat spring in the form of a curved plate may be provided between the pair of panels in order to bias the first panel away from the second panel into the expanded position when the one or more latch is released.

Optionally, one or more further panels may be provided, which may be rested or friction fitted in the base or the lid of the case. Further panels may also be rotatably attached to the body of the case, or to one of the pair of hinged panels, in order to provide additional storage compartmentalisation.

The pair of hinged panels may be a similar size and shape to each other, or may be different. The hinged panels may be generally rectangular in shape, or may be shaped at the sides or top, for example tapered towards the top or bottom. The overall arrangement of the panels and compartments may be different according to the specific type of tools which are intended to be carried in the case.

A strap or other connector such as a hinged strut made of relatively rigid plastic, may be provided in between the first and second panels of the pair of panels, to brace them in the extended position. Alternatively, no connector may be provided. The pair of panels may be self-supporting.

The pair of hinged panels and any further panels may be detachable from the body of the case, either in one unit, or singly. Such an arrangement can provide additional storage arrangement options, for example, the body of the case may be left on the ground while one or more panels are detached and carried to a remote location to carry out a part of the job for which a sub-set of the tools in the case are required. The detached panel or panels may then be reattached to the body of the case when that part of the job has been completed. If the pair of panels is detached from the body of the case, the pair of panels may be free to open out flat in relation to each other, or they may be provided with a connecting strut or strap which allows them to stand in an A-frame configuration on a surface remote from the body of the case.

The lid and base of the case may be provided with storage sub-compartments, for example, in the form of storage cups or dividers which may be movable or even removable. For example, the base of the case may be provided with a plurality of cups for storing small components, and which are covered with a further panel in order to retain the components in the cups, until the user lifts the panel in order to access the components. The panel may be hingedly attached to the base of the case, or it may be friction fitted into position above the cups.

Optionally, cushioning may be provided a various points within the case, for example in the lid of the case in order to cushion and prevent unwanted movement of heavy tools held in the rear pallet when it is in the closed position. Furthermore, formed cushioning, which may be used to hold a power tool, may be provided within the case, for example in the base of the case.

The case may comprise a support being constructed and arranged such that when the lid is in the opened position, the support engages a surface on which a bottom surface of the case rests, so as to support the lid in the open position, the support being constructed and arranged to be positioned proximate to the case when the lid is closed, and movable to an extended supporting position when the lid is in an open position. Such supports are disclosed in U.S. Pat. No. 8,210,387. A support of this kind may comprise a first portion and a second portion, connected by a hinge, the hinge being constructed and arranged to enable the first portion of the support to pivot relative to the second portion of the support. Alternatively the support may comprise three portions rotatably connected to each other at a central pivot, the remote end of the first portion being connected to the case, the remote end of the second portion being connected to the case at a different point to the remote end of the first portion, and the remote end of the third portion being free to engage the surface.

Each hinge attachment between components may be in the form of any known hinge type, including a living hinge or a pin hinge, for example.

BRIEF DESCRIPTION OF THE DRAWINGS

The invention is herein described, by way of example only, with reference to the accompanying drawings, wherein.

DETAILED DESCRIPTION OF THE DRAWINGS

Figure 1:
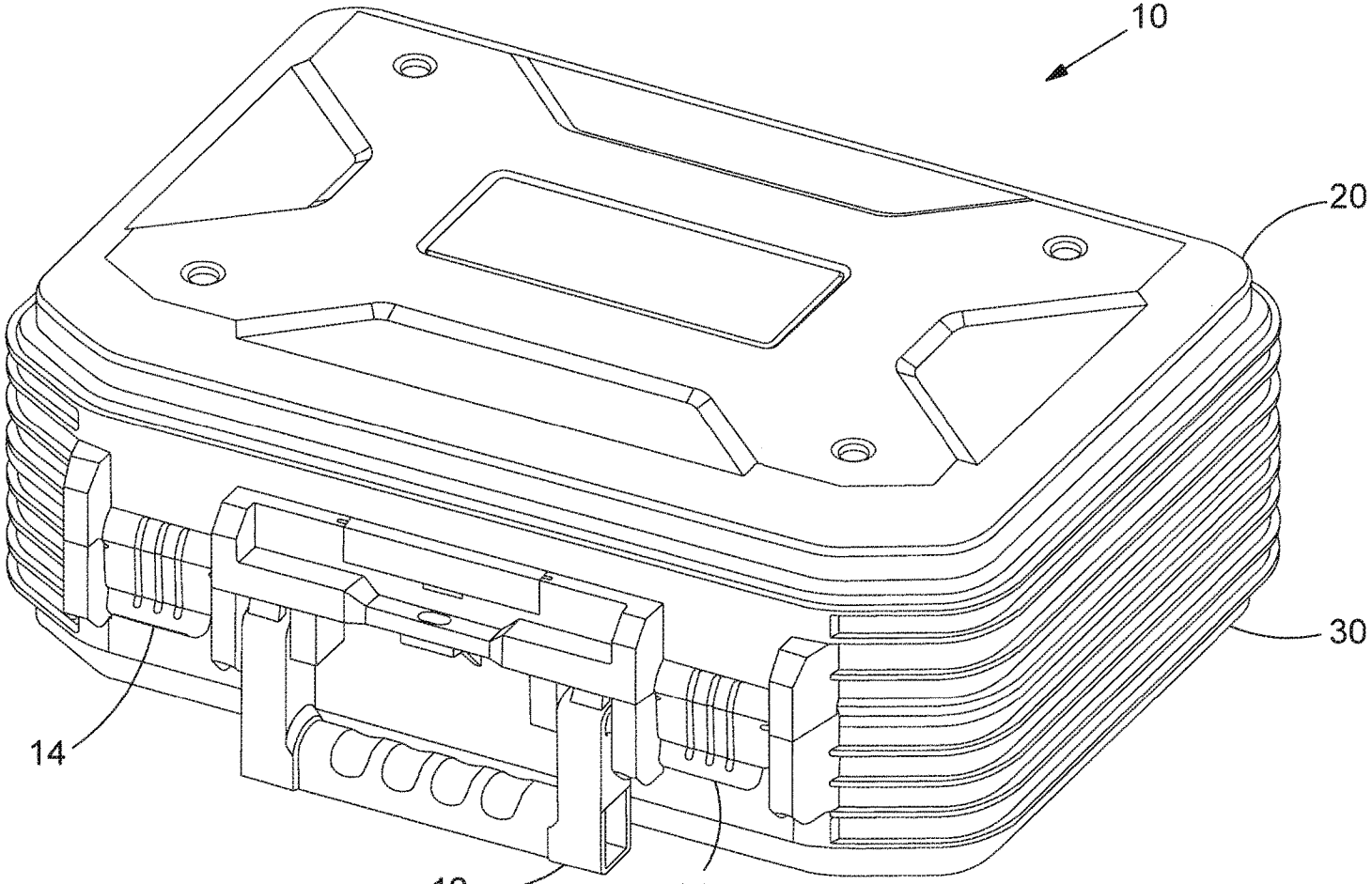
FIG. 1 is a perspective view of a case according to the invention, in a closed position.

FIG. 1 shows a case of a type which may comprise the features of the claimed invention. The case 10 has a lid 20 and a base 30, and is provided with an external handle 12 to allow the case to be carried easily. Two hinged latches 14 are provided on the base such that the latches can be fastened onto latching sections of the lid in order to latch the case into a closed position. Alternatively, one latch or a plurality of latches may be provided and arranged to latch the case into a closed position. The body of the case or container may be made of any suitable material, for example, metal, plastic, fabric or composite material, or a combination of suitable materials. Latches to latch the lid and the base together may be provided on the base as shown or on the lid, in any known arrangement.

Optionally, one or more further external handles may be attached to the outside of the case, to provide alternative options for moving or carrying the case. One or more pairs of wheels or castors may also be provided in order to allow easy transportation of the case, for example, a further external handle may be provided at one of the short edges of the case, and a pair of wheels may be attached externally to the case near the opposing short edge of the case, such that the case may be raised using the further external handle and wheeled across a surface. Such an external handle may be a telescopic or folding handle which can be extended for transportation and collapsed when not in use.

Figure 2A:
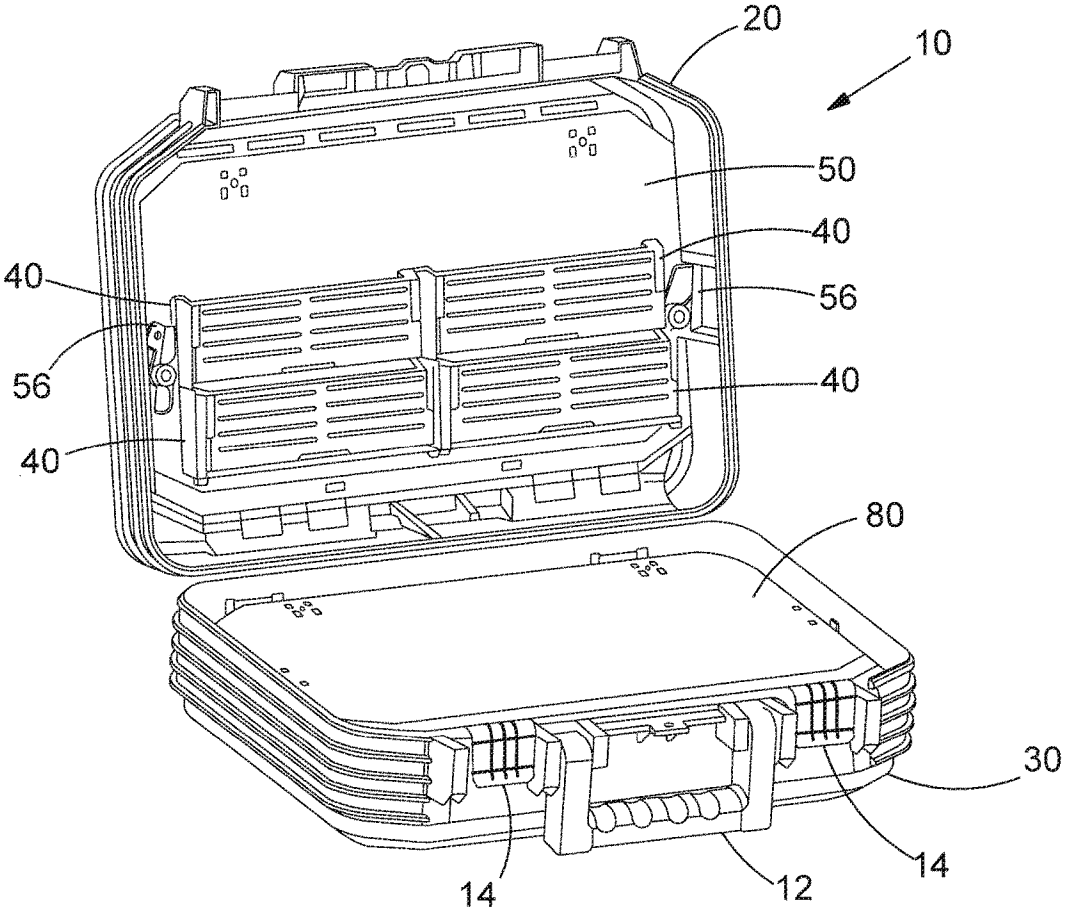
FIG. 2*a* is a perspective view of the case of FIG. 1 in which the lid is in an open position, and the pair of panels are in a stowed position.

FIG. 2*a* shows the case 10 in which the lid 20 is in an open position. The first panel 50 of a pair of panels, is visible within the case. Panel 50 carries a plurality of racks 40 in the form of pockets standing proud of the surface of panel 50, in order to provide organized storage space for tools or other items to be carried in the case. Panel latches 56 are also provided.

Further panel 80 is shown in a covering position within the base 30, in order to further subdivide the storage space inside the case 10. Further panel 80 may rest upon ledges formed in the internal walls of the base 30, and may be freely lifted out of the case by a user, in order to gain access to the storage space underneath. Alternatively, further panel 80 may be rotatably attached to the body of the case by a hinge, such that a user may rotate the further panel in order to access the storage space underneath. Such storage space may be subdivided by one or more movable cups, or by straight dividers which may interlock with each other, as known in the art.

Figure 2C:
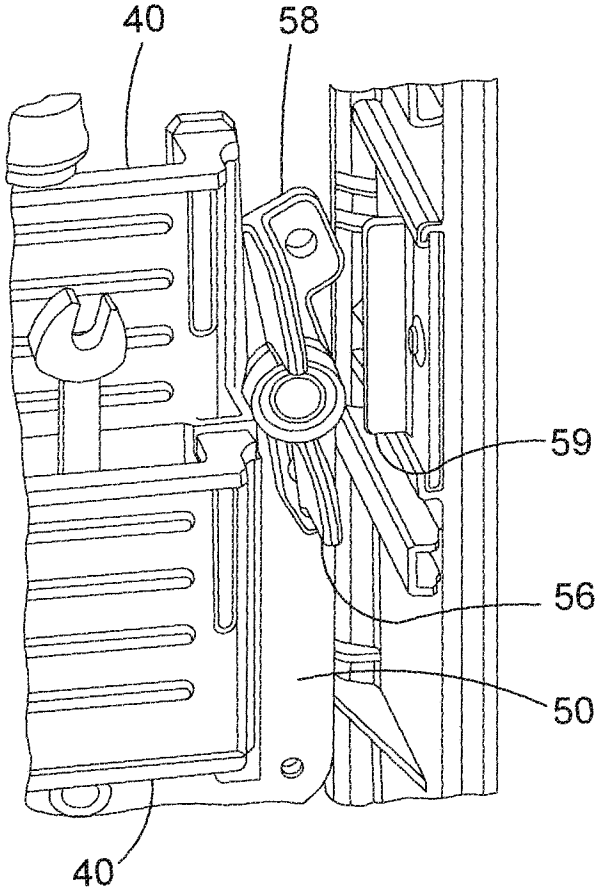
FIGS. 2*b* and 2*c* show a close up of a portion of FIG. 2.
Figure 2B:
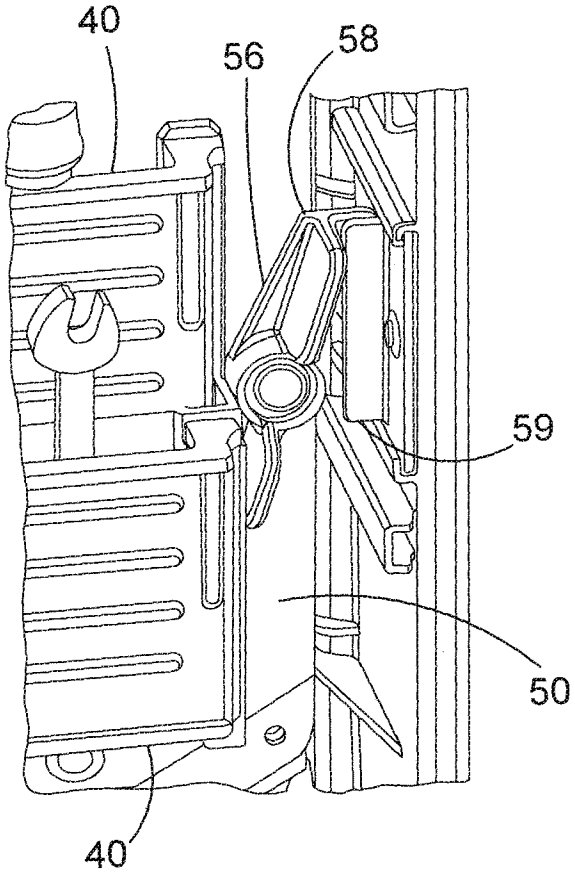

FIG. 2*b* shows a close-up portion of the case of FIG. 2*a*, showing one of the two panel latches 56 in a latched position, and FIG. 2*c* shows the same panel latch 56 in an unlatched position. Panel latch 56 is rotatably connected to front panel 50, and can be turned between a latched position in which latch head 58 is retained by protrusion 59 of lid 20, and an unlatched position in which latch head 58 is not retained by protrusion 59 as in FIG. 2*a*, which allows the pair of panels to be moved from the stowed position to an expanded position. Preferably, at least two similar latches are provided to retain the pair of panels in the stowed position within the case, at separated points near the perimeter of the pair of panels. As shown in FIG. 2, two similar latches 56 may be provided, one at each short side of the pair of panels.

Figure 3:
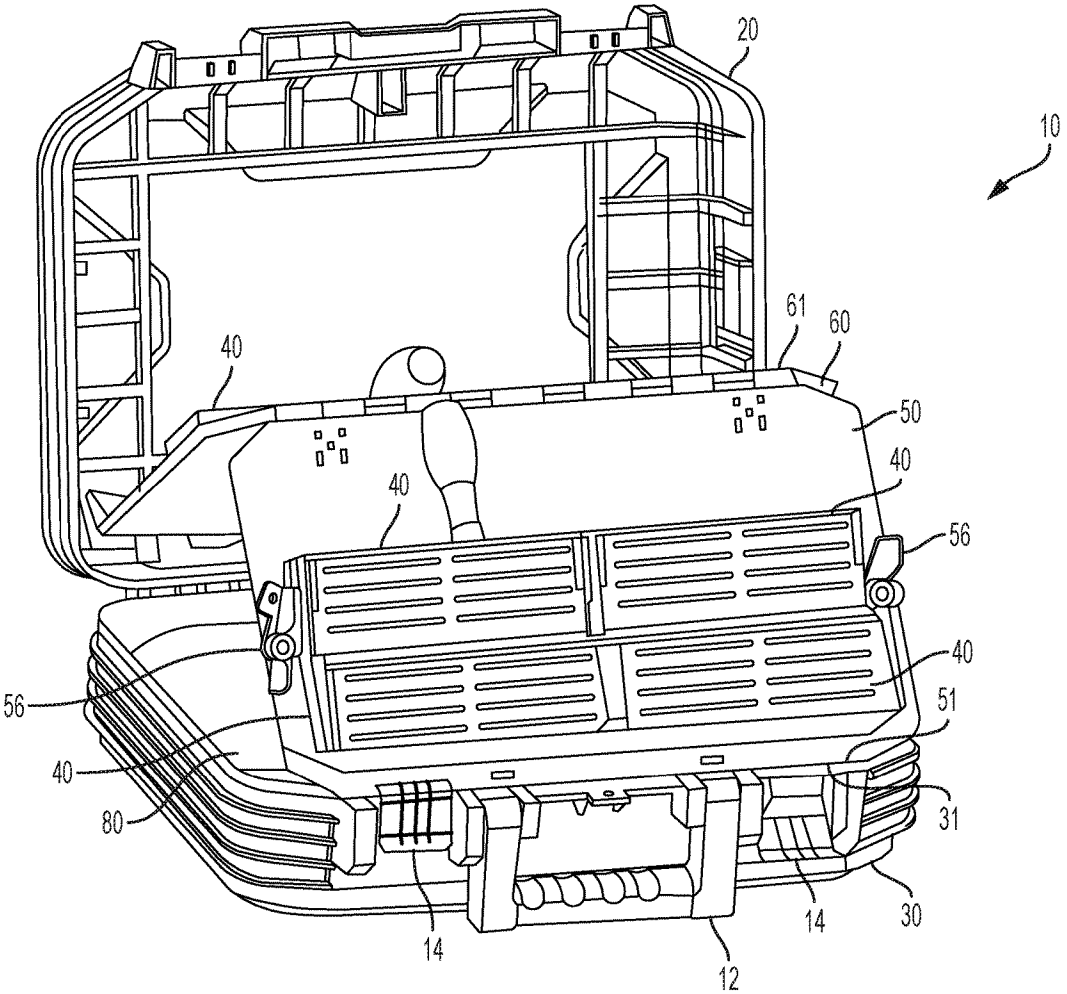
FIG. 3 is a perspective view of the case of FIG. 2 in which the pair of panels are in an extended position.

FIG. 3 shows the case 10 in which the lid 20 is in an open position and the pair of panels comprising first panel 50 and second panel 60 are in an expanded position. Second panel 60 also carries a rack 40, on the panel face which faces outwards when the pair of panels is in the expanded position shown, and the pair of panels are joined at a common hinged edge 61. FIG. 3 shows tools positioned in two of the racks 40. First panel 50 has an unfixed edge 51, which is not directly connected to the body of the case. In the open position, the unfixed edge 51 abuts a stop 29 at the front external edge 31 of the base 30, which permits the pair of panels to be braced in an expanded position to provide a stable and easily accessible presentation of the items carried by the pair of panels.

In the first panel of FIG. 3, the edge opposite the common hinged edge with the second panel is the unfixed edge 51, but in alternative arrangements the unfixed edge may be adjacent to the common hinged edge. For example, the common hinged edge of the pair of panels may be a side edge rather than a top edge, when the case is in normal orientation for use, and the unfixed edge 51 may be the bottom edge. If further panels are attached to the pair of panels, they may be hingedly attached at any edge or surface of the pair of panels, for example, a further panel may be hingedly attached to the common hinged edge of the pair of panels, to the fixed edge of the second panel, to the unfixed edge 51 of the first panel 50, or to other free edges of the first or second panels. If further panels are attached to the pair of panels, it is beneficial if there is an arrangement in which such further panels can be expanded and retained in a position in order to display any tools carried on their surface.

Figure 4:
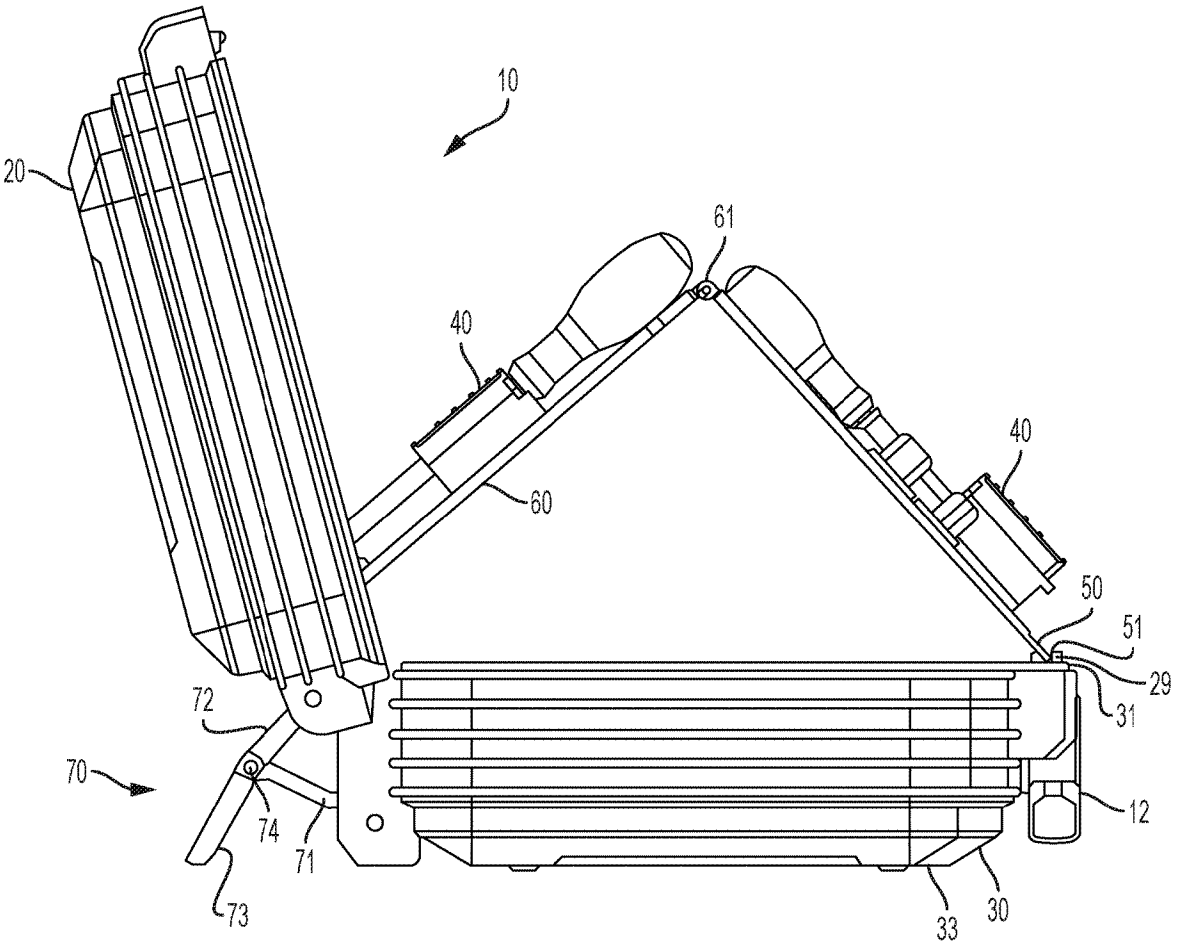
FIG. 4 is a side view of the case of FIG. 3.
Figure 5:
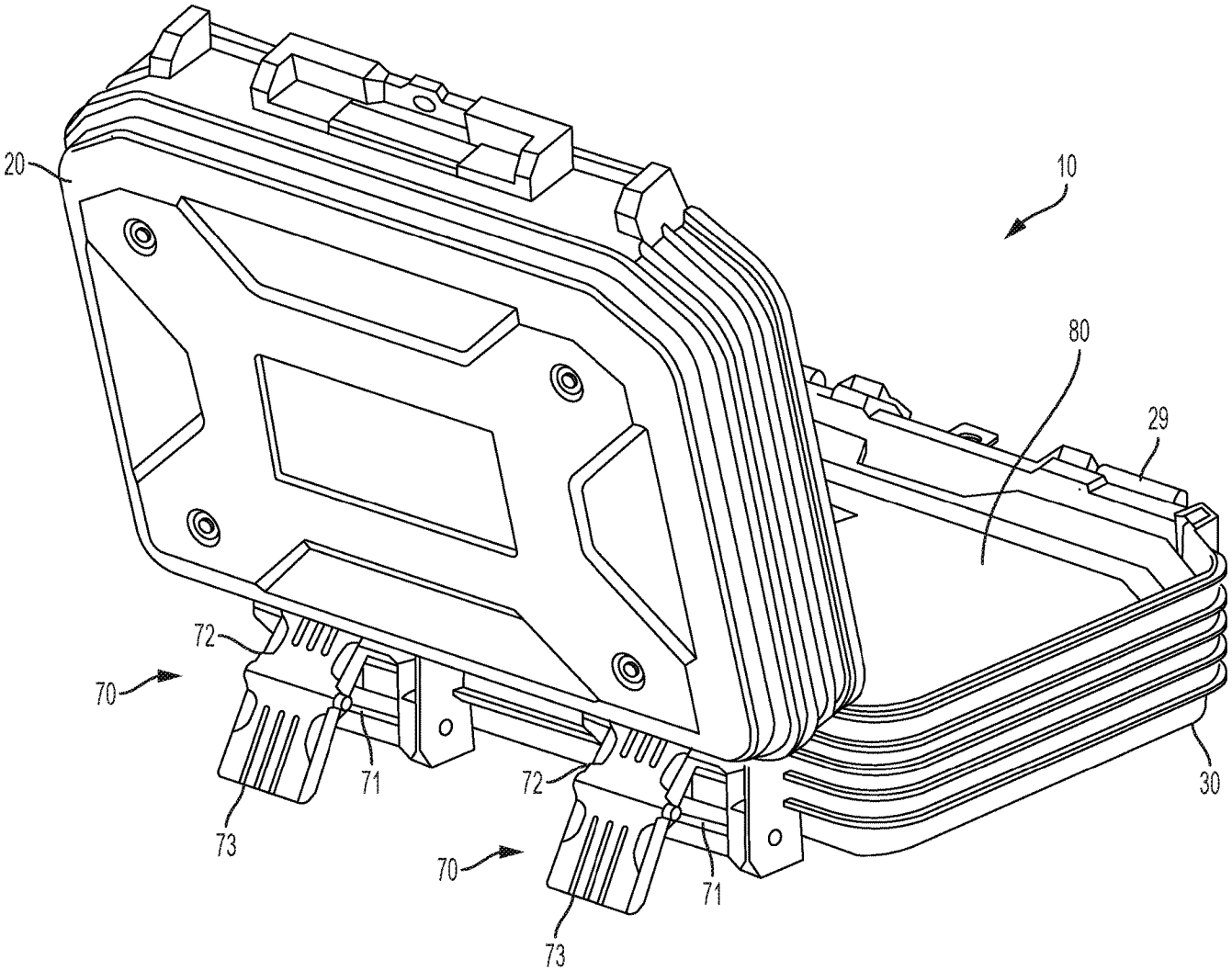
FIG. 5 is a rear perspective view of a case according to the invention, further comprising two lid supports.

FIG. 4 shows the case of FIG. 3 in a side view, and further shows a support 70 which is constructed and arranged to engage a surface on which a bottom surface 33 of the base 30 rests when the lid is in the opened position, so as to support the lid in the open position. The support 70 is arranged such that the main parts of the support are positioned proximate to the case 10 when the lid 20 is closed, but when the lid is opened, the support automatically moves into an extended supporting position. The support 70 comprises three portions 71, 72 and 73, rotatably connected to each other at a central pivot 74, the remote end of the first portion 71 being connected to the case, the remote end of the second portion 72 being connected to the case at a different point to the remote end of the first portion, and the remote end of the third portion 73 being free to engage the surface. FIG. 5 shows a rear perspective view of the case of FIG. 4, showing two supports 70, which are located close to opposite ends of a long edge of lid 20. Such support or supports may be provided at any location close to the hinge between the lid 20 and base 30 of a case, but it is preferable to provide two or more separate supports at intervals, in order to provide good support for the lid.

Figure 6:
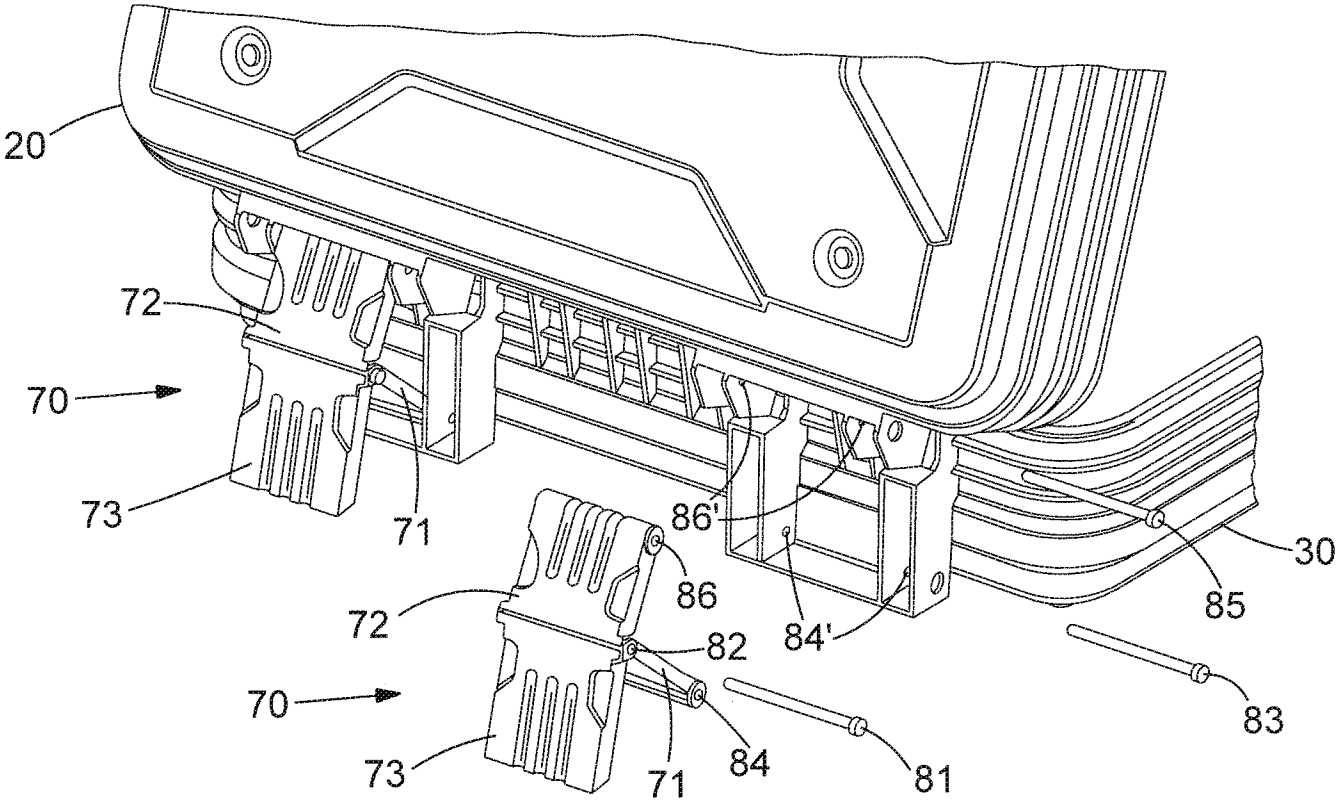
FIG. 6 is an exploded partial view, showing the supports of FIG. 5.

FIG. 6 shows details of the construction of supports 70. The three portions 71, 72 and 73 are rotatably connected together at central pivot 74 by a pin 81 which is passed into hole 82. In a similar way, the remote end of the first portion 71 is connected to the body of the case by a pin 83, which is passed into holes 84 located on the first portion and holes 84' located on the base 30, and the remote end of the second portion 72 is connected to the body of the case by a pin 85, which is passed into holes 86 located on the second portion and holes 86' located on the lid 20. The lengths of the three sections of the support, and the separation between the points at which the first and second sections are attached to the body of the case, are such that when the lid of the case is closed, all three sections of the support are folded relatively flat in proximity to the side of the case. The holes 84' and 86' are positioned such that the pivotal movement of the lid during opening, brings holes 84' into closer proximity to holes 86', which acts to move central pivot 74 away from the body of the case such that the support folds out and the free end of the third portion 73 moves away from the base of the case and can be rested on a surface in order to prop the lid of the case in a stable position. This can prevent over-extension of the hinge between the lid and the base, and can retain the lid in a suitable position for the pair of panels to be opened into an expanded position while maintaining stability of the case.

Figure 7:
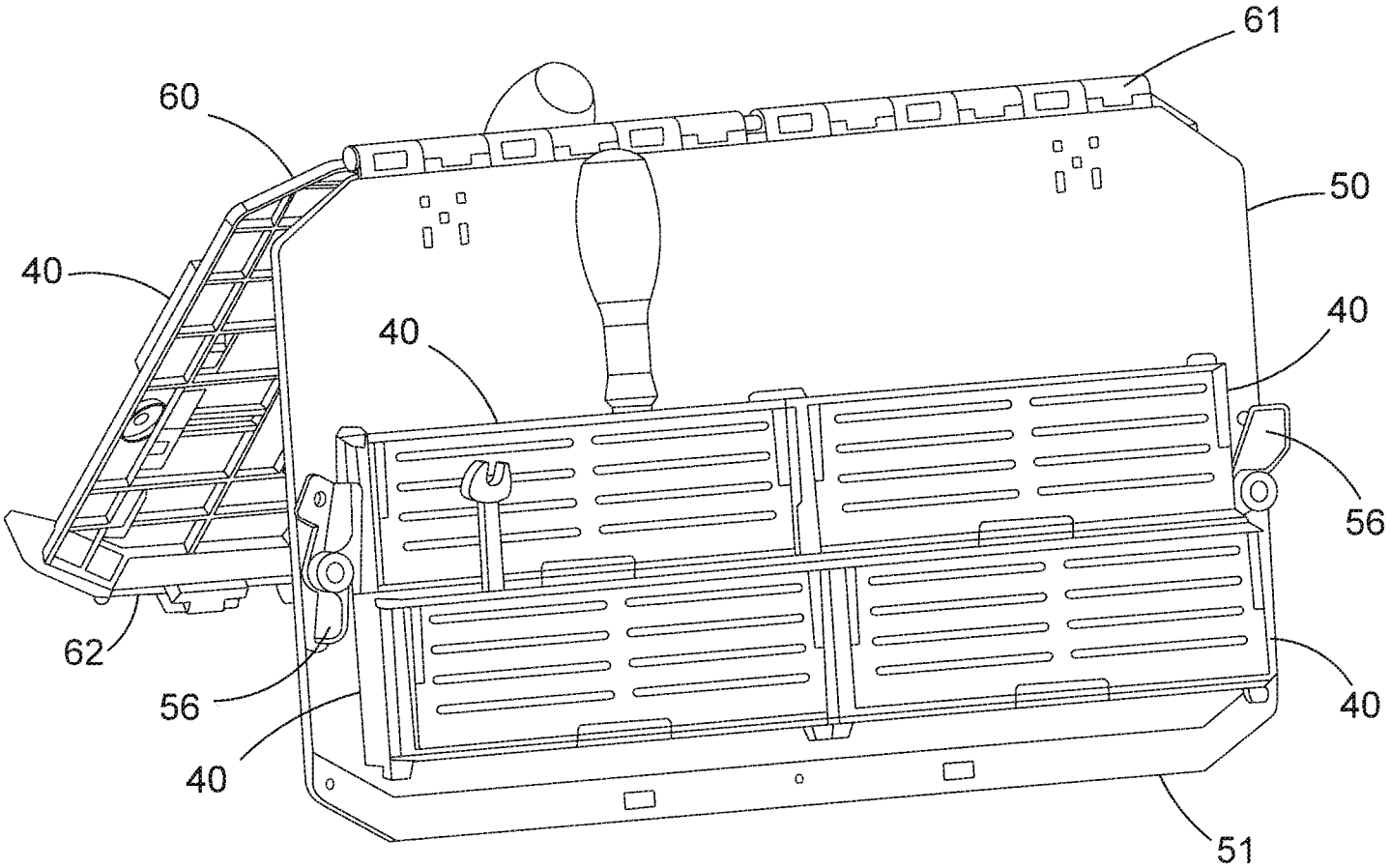
FIG. 7 is a perspective view of a pair of panels detached from a case.
Figure 8:
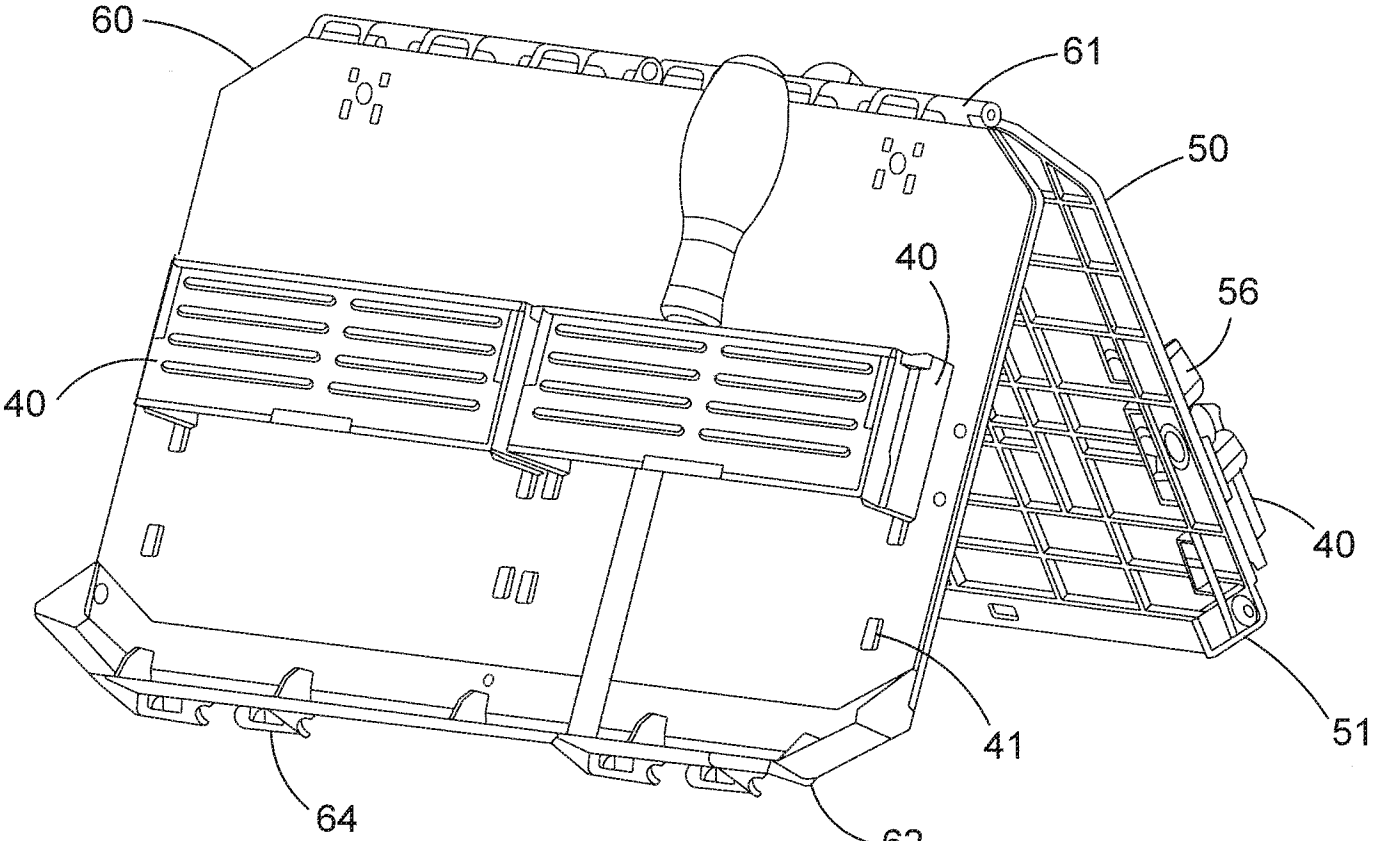
FIG. 8 is another perspective view of the panels of FIG. 7.

The pair of panels may be able to be detached from the body of the case, as shown in FIG. 7, or they may be permanently attached to the body of the case. FIG. 8 shows the second panel 60 of the pair of panels in more detail, including the fixed edge 62 and racks 40. FIG. 8 shows attachment points 41 by which additional racks of the same type as racks 40 shown, or of different types, may be attached to the panel. Alternatively, racks may be attached by gluing, by sewing, by molding, by forming at original manufacture of the panel, or by any other known method. Racks of any type may be provided, for example, racks may be in the form of plastic or metal cups or bands attached to the panel to hold tools against the surface of the panel, or strips of webbing sewn to the panels in loops such that tools can be slotted into the loops. Elastic straps or pockets made of mesh fabric may also be provided.

Second panel 60 has hinge parts 64 located at one edge, which can be fixed to the body of the case at a corresponding hinge part. In the case shown in FIGS. 1 to 6, the hinge parts 64 of the second panel are fixed to corresponding hinge parts located in the lid of the case using a hinge pin, and in the stowed position the pair of panels are folded into the space encompassed by the lid of the case. However, the fixed edge of the second panel may be attached to the body of the case at different positions if desired for an alternative panel arrangement. As an alternative to a pin-hinge attachment, second panel 60 may be fixed to the body of the case via a living hinge or in any other manner which allows rotation between a stowed position and an expanded position.

In order to simplify the manufacture of the case, the panels may be in the form of identical plates to which additional parts may be clipped or glued in order to equip them for use as a first panel, a second panel or a further panel. For example, the second panel of FIGS. 7 and 8 comprises one plate and one foot which snaps on to an edge of the plate, the foot carrying the hinge part 64 required to connect the second panel to the lid with a hinge pin. It will be recognized that by attaching no foot, or a foot with a different shape, a panel suitable for use as a first panel or a further panel could be provided.

Figure 9B:
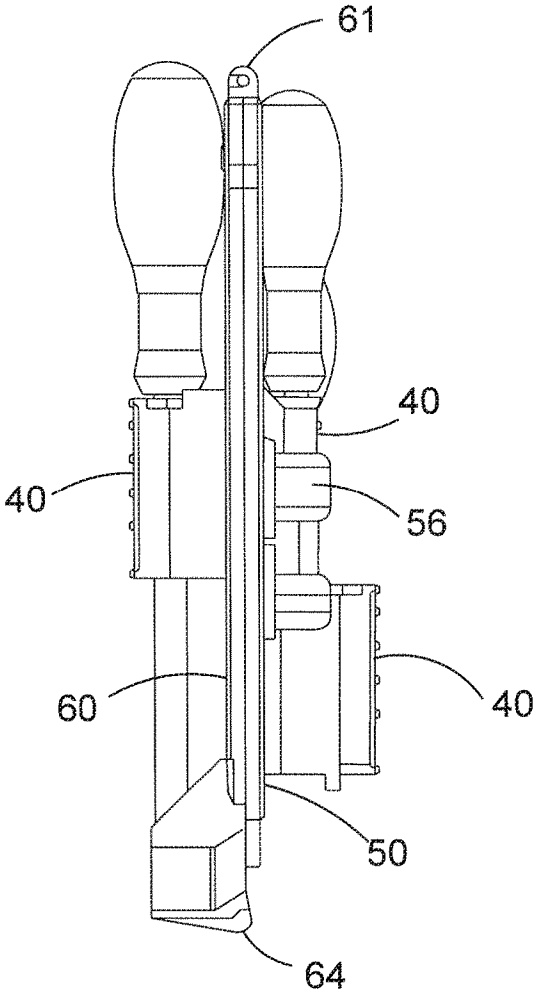
FIG. 9*b* is a side view of the pair of panels of FIG. 7.
Figure 9A:
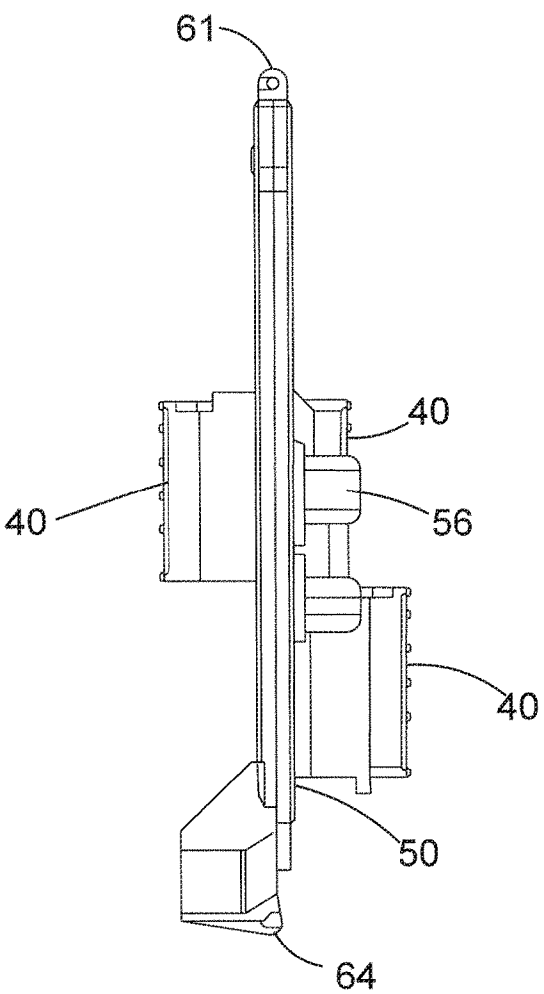
FIG. 9*a* is a side view of the pair of panels of FIG. 7.
Figure 10B:
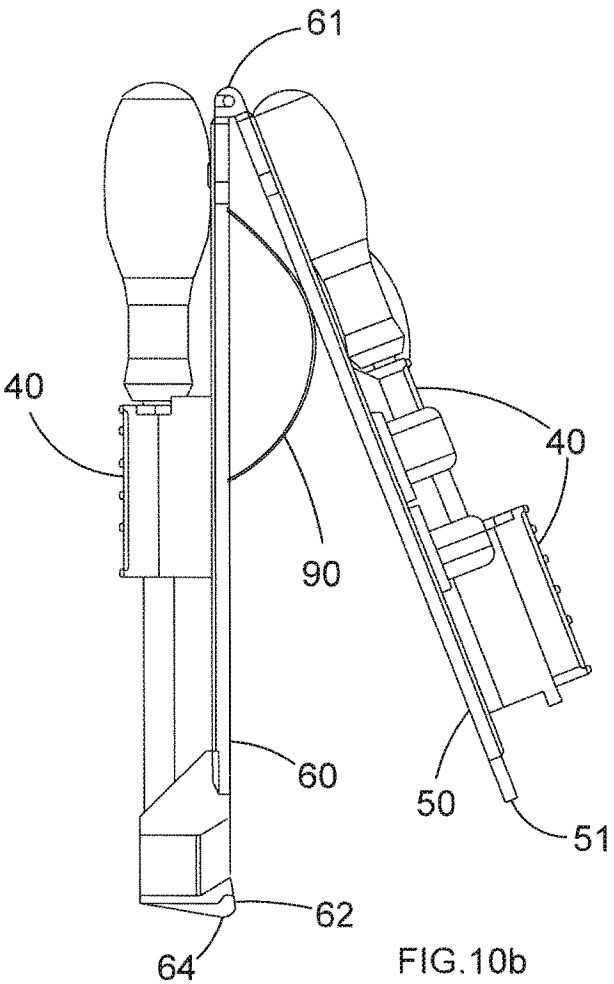
FIG. 10*b* is a side view of the pair of panels of FIG. 7.
Figure 10A:
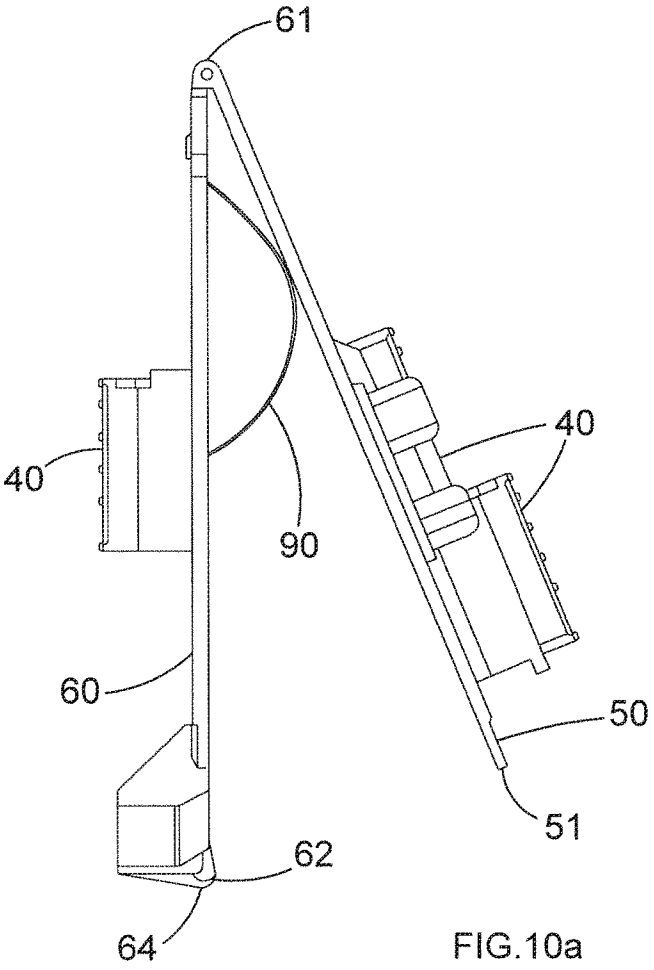
FIG. 10*a* is a side view of the pair of panels of FIG. 7.
Figure 11:
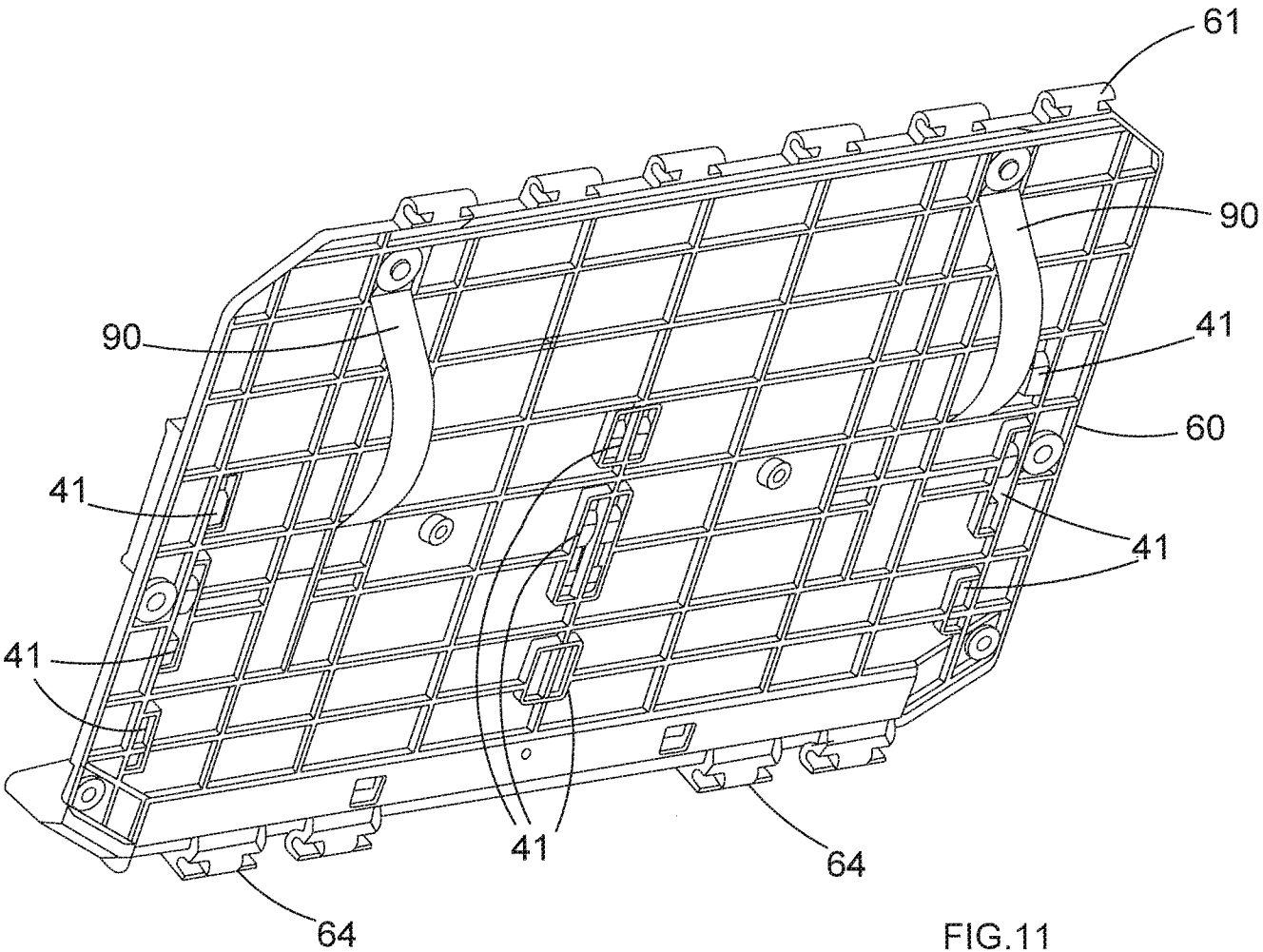
FIG. 11 is a perspective view of one panel.

FIGS. 9*a* and 9*b* show a pair of panels separated from the body of the case. In FIG. 9*a* the racks 40 are empty, and in FIG. 9*b* the racks are shown carrying a number of tools. FIGS. 10*a* and 10*b* show the same pair of panels, and in FIG. 10*a* the racks 40 are empty, and in FIG. 10*b* they carry a number of tools. FIGS. 10*a* and 10*b* also show spring 90 which may be attached to second panel 60 and which biases the first panel away from the second panel. One or more springs may be provided at separate locations on the second panel 60, or alternatively on the first panel instead of the second panel. FIG. 11 shows second panel 60 without the first panel attached, and separated from the body of the case, in order to show the attachment of two springs 90. If a case according to the present invention is provided with a latch or latches 56, and one or more biasing springs, then the latch 56 should be sufficiently strong that is it capable of retaining the pair of panels in the stowed position against the bias of the spring or springs, until they are unlatched by the user. FIG. 11 also shows a number of attachment points 41, which in this embodiment are in the form of slots in panel 60, formed such that protrusions on the racks 40 can be inserted such that the racks are attached to the panel 60. In some embodiments, the protrusions and slots may be formed in such a manner that it is possible for a user to easily remove a sub-compartment from a panel, and reattach it at a different location on the same panel or another panel, in order to rearrange the internal storage of the case to suit a particular purpose.

It should be understood that although the invention has been described in conjunction with specific embodiments thereof, it is evident that many alternatives, modifications and variations will be apparent to those skilled in the art. Accordingly, it is intended to embrace all such alternatives, modifications and variations that fall within the scope of the claims.

The invention claimed is:

1. A case for organizing and transporting a plurality of tools, the case comprising;

a body, the body comprising a base and a lid, wherein the lid is pivotally connected to the base;

a storage space substantially defined by the base and lid, such that the storage space is accessible when the lid is in an open position but is not accessible when the lid is in a closed position;

a first panel and a second panel pivotally connected to one another at a common hinged edge and disposed in the storage space;

wherein, when the lid is in the open position, said first and second panels being movable between a stowed position, and an expanded position, such that in the expanded position at least one surface of the first panel and at least one surface of the second panel are accessible;

wherein the first panel further comprises at least one unfixed edge, the second panel further comprises at least one fixed edge, the fixed edge being pivotally connected to the body of the case; and wherein in the stowed position, the unfixed edge of the first panel is substantially proximate to the fixed edge of the second panel, and in the expanded position, the unfixed edge of the first panel is substantially distant from the fixed edge of the second panel and the common hinged edge forms an apex above the case.

2. The case according to claim 1, wherein the unfixed edge of the first panel is opposite to the common hinged edge of the first panel, and wherein the fixed edge of the second panel is opposite to the common hinged edge of the second panel.

3. The case according to claim 1, wherein the first panel and second panel include one or more storage racks.

4. The case according to claim 3, wherein when the first panel and second panel are in the stowed position, the storage racks of the second panel are cradled within the lid of the case.

5. The case according to claim 4, wherein when the first panel and second panel are in the stowed position, the storage racks of both the first panel and the second panel are cradled within the lid of the case.

6. The case according to claim 1, wherein the body of the case comprises a stop, such that when the first panel and second panel are, in the expanded position, the unfixed edge of the first panel abuts the stop and the first panel is held at a stable position in relation to the body of the case.

7. The case according to claim 1, further comprising one or more latches arranged to latch the first panel and second panel in the stowed position in relation to the body of the case, wherein release of the one or more latches allows the first panel and second panel to move into an expanded position in relation to the body of the case.

8. The case according to claim 7, wherein the pair of panels comprises a spring arranged to bias the pair of panels into the expanded position when the one or more latch is released.

9. The case according to claim 1, further comprising one or more supports attached to the body of the case, such that the supports are arranged to be in a position proximate to the case when the lid is in a closed position, and movable to an extended supporting position when the lid is in an open position.

10. The case according to claim 9, comprising two supports, wherein each of the two supports comprises three portions rotatably connected to each other at a central pivot, a remote end of the first portion being connected to the body of the case, a remote end of the second portion being connected to the body of the case at a different point to the remote end of the first portion, and a remote end of the third portion being free to engage a surface upon which a bottom of the case is rested.

* * * * *